US005842524A

United States Patent [19]

Farmer

[11] Patent Number: 5,842,524

[45] Date of Patent: Dec. 1, 1998

[54] SHRINK-WRAP FIRE EXTINGUISHING METHOD AND CONTAINER

[75] Inventor: Kent R. Farmer, San Antonio, Tex.

[73] Assignee: Southwest Research Institute, San Antonio, Tex.

[21] Appl. No.: 738,938

[22] Filed: Oct. 24, 1996

[51] Int. Cl.[6] ..... A62C 3/00

[52] U.S. Cl. ..... 169/45; 169/46; 169/49; 220/88.1

[58] Field of Search ..... 169/45, 46, 49; 220/88.1

[56] References Cited

U.S. PATENT DOCUMENTS

| | | | |
|---|---|---|---|
| 1,606,935 | 11/1926 | Haas | 220/88.1 |
| 1,832,056 | 11/1931 | Spencer | 169/26 |
| 2,384,526 | 9/1945 | Blake | 169/49 |
| 2,802,538 | 8/1957 | Subarsky | 169/49 |
| 3,022,543 | 2/1962 | Baird, Jr. et al. | 428/34.9 |
| 3,102,543 | 9/1963 | O'Siel et al. | 131/349 |
| 3,182,727 | 5/1965 | Minton | 169/49 |
| 3,312,337 | 4/1967 | Martin | 206/497 |
| 3,607,505 | 9/1971 | Schirmer | 156/156 |
| 3,904,070 | 9/1975 | Lisciani et al. | 220/88.1 |
| 3,988,499 | 10/1976 | Reynolds | 428/216 |
| 4,250,967 | 2/1981 | Horwinski et al. | 169/49 |
| 4,264,010 | 4/1981 | Yoshiga et al. | 206/497 |
| 4,676,463 | 6/1987 | Tansill | 244/129.2 |
| 5,421,127 | 6/1995 | Stefely | 52/1 |

OTHER PUBLICATIONS

"Emulsion Polymerization to Fibers, Manufacture." *Encyclopedia of Polymer Science and Engineering,* (V.6), 1986, pp. 421–422.

"Fibers, Optical to Hydrogenation." *Encyclopedia of Polymer Science and Engineering,* (V.7), 1987, pp. 81–82.

*Primary Examiner*—Andrew C. Pike

*Attorney, Agent, or Firm*—Madan & Morris, PLLC

[57] ABSTRACT

A container comprises a shrink wrap material having a thickness and a height sufficient that, upon exposure to a potential fire source inside of the container, at least a portion of the container shrinks in an amount sufficient to reduce the oxygen supply to the potential fire source inside of said container.

19 Claims, 3 Drawing Sheets

SHRINK-WRAP FIRE EXTINGUISHING METHOD AND CONTAINER

FIELD OF THE INVENTION

The present invention relates to the field of containers, generally, and specifically to waste, storage, and shipping containers designed to reduce the risk of fire. More particularly, the invention relates to waste disposal, storage, and shipping containers, or liners therefor, made at least in part of a material that shrinks upon exposure to heat, forming a barrier that deprives the fire of oxygen and extinguishes the fire inside of the container.

BACKGROUND

According to the National Fire Protection Association, millions of dollars and many lives are lost each year to fires that originate in waste containers in high rise office buildings, hotels, and family dwellings, alone. A cigarette, a match, a smoldering cloth, or another ignition source dropped into a waste container or accidentally dropped on or into a storage container may ignite the contents of the container and result in a raging, highly destructive fire. O.S.H.A. has issued regulations under which all containers in factories must be provided with either a cover or a device which will extinguish a blaze. Unfortunately, the O.S.H.A. regulations do not extend to all buildings, and the products that have been developed to date for factories have not adequately reduced the risk of fire.

One of the proposed solutions has been to provide waste containers with a lid or cover that automatically closes the container upon exposure to fire. The lid or cover theoretically should deprive the fire of oxygen and thereby extinguish the fire. However, the devices used to date either do not adequately shut off the supply of oxygen to the fire or are relatively complicated in construction and/or expensive to use.

A relatively uncomplicated and inexpensive container or liner that would effectively cut off the supply of oxygen to a fire contained within the container would be very desirable.

SUMMARY OF THE INVENTION

The present invention provides a container at least in part made of shrink wrap material defining an enclosed area having a first diameter. The container is configured so that, when a potential fire source is in the enclosed area, the shrink wrap material shrinks to a second, smaller diameter, reducing oxygen supply to the potential fire source.

DESCRIPITON OF THE DRAWINGS

DETAILED DESCRIPTION OF THE INVENTION

Figure 1:
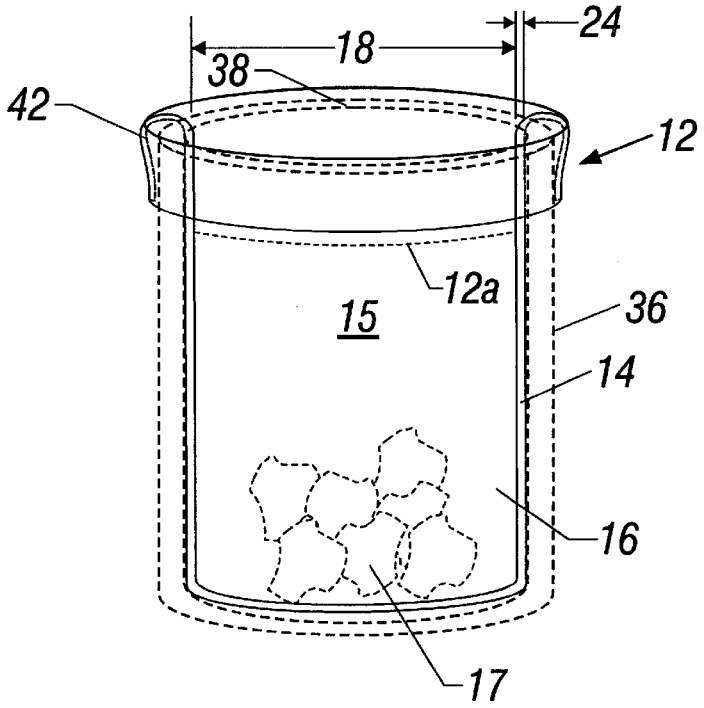
FIG. 1 is a perspective view of a waste container shown in dotted lines containing a waste container liner (shown in cross section) comprising a section of shrink wrap material around a top end. Dotted lines also are used to indicate (a) waste contained in the waste container, and (b) the extent of the top end of the waste container liner that is made of shrink wrap material.

Shrink wrap film or packaging is a film made of thermoplastic polymers that shrinks in a biaxial mode between about 20–60%, even up to about 65%, when exposed to sufficient heat. Typically, the film is folded and the product to be sealed is inserted. The film then is heat-sealed around the edges. The product, loosely wrapped by the film, is exposed to hot air so that the film shrinks around the product. Shrink wrap films currently are used to provide sanitary packaging for various food products and to provide an airtight seal for packaging electronic components, such as PC cards and chips.

Substantially any material that shrinks but otherwise maintains substantial integrity upon exposure to heat should function in the present invention, and the invention is not limited to the shrink wrap materials that are currently known. Currently known shrink wrap materials are polyvinyl chloride, polyolefins and copolyolefins, primarily containing polyethylene, polypropylene, or mixtures thereof, and copolymers of said polyolefiins with ethylene vinyl acetate (EVA), such as low density polyethylene (LDPE)/EVA copolymers and/or LLDPE/EVA copolymers.

Shrink wrap films are nontoxic at ambient temperatures. When heated or burned, shrink wrap films are no more toxic than existing plastic/polymer bags. Currently, shrink wrap films are produced in film thicknesses of 60–165 gage; however, shrink wrap material having a greater or lesser thickness would be useful in the present invention. All properties of shrink wrap material (e.g., activation temperature, shrink rate, shrink force, thermal capacitance, infrared thermal emissivity, etc.) can be tailored for a specific product application using methods known to persons of ordinary skill in the art.

Substantially any shrink wrap material will function in the present invention. Typical shrink wrap materials are made of polyvinyl chloride or polyolefins, such as polypropylene, polyethylene, etc. Suitable shrink wrap materials are available from numerous commercial sources and include, but are not necessarily limited to: CLYSAR®, which is available from E. I. DuPont de NeMours Int'l SA, DuPont Packaging and Industrial Polymers, Wilmington Del.; CRYOVAC®, available from W. R. Grace & Co., P. O. Box 464, Duncan, S.C. 29334; FILM SOTERM C-3, available from Tantraco Enterprise PTE, Ltd., Block 5071, Ang Mo Kio Industrial Park, #190 04156, Singapore, China 2056; shrink film available from Huntsman Chemical, 3575 Forest Lake Drive, Uniontown, Ohio 44685; and electronic shrink wrap bags made of polyvinyl chloride, available from National Bag Company, Inc., 2233 Old Mill Road, Hudson, Ohio 44236. A variety of shrink wrap film products, which currently are designed to provide sanitary packaging for food products or to provide an airtight seal for packaging electronic components, are available from National Bag Company, Inc., and Traco Mfg., Inc., 443S. Commerce Road, Orem, Utah. A preferred shrink wrap material is the electronic shrink wrap bag material available from National Bag Company, Inc. (polyvinyl chloride).

In one embodiment of the present invention, shrink wrap material is applied around the top portion, and only the top portion, of a typical inflammable waste container liner. When a fire occurs in the lower portion of the bag and progresses, the fire cannot burn through the lower portion of the bag. As the exiting heat/flame passes by the shrink wrap material section at the top of the bag, the shrink wrap material shrinks, thereby effectively closing off the top portion of the bag to air/oxygen supply which results in smothering the fire.

Figure 2:
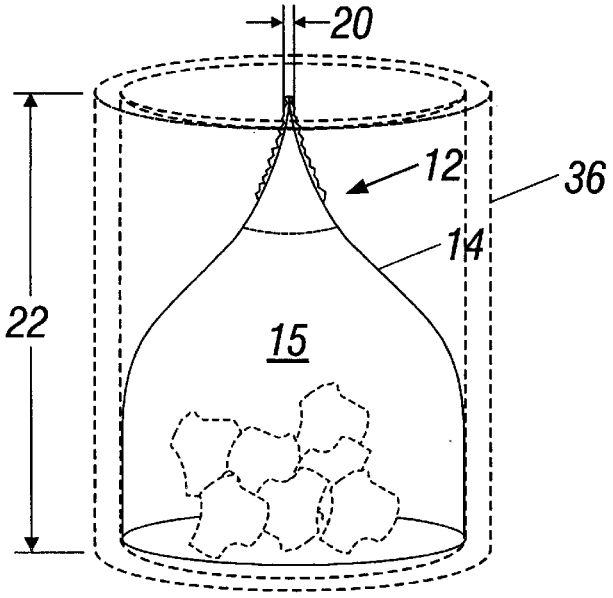
FIG. 2 is a perspective view of the waste container and waste container liner of FIG. 1 after shrinkage of the shrink wrap material around the top end of the waste container liner.

This first embodiment is illustrated in FIG. 1. Referring to FIGS. 1 and 2, a section 12 of shrink wrap material ending at the dotted line 12*a* has a given thickness (24 in FIG. 1) and forms the top portion of the waste container liner 14 (FIGS. 1 and 2). The waste container liner 14 comprises a substantially enclosed area 15 for containing waste 17. The waste container liner 14 can have any number of configurations as long as the thickness 24 is small enough to provide sufficient flexibility for the liner 14 to collapse into the waste container 36 and for an upper rim 42 of the liner 14 to fold around the upper rim 38 of the waste container 36 having a given height 22. The upper rim 42 of the liner 14 holds the liner 14 extended from the upper rim 38 of the waste container 36.

As seen in FIG. 2, when a fire occurs in the lower portion 16 of the liner 14, the heat/flame passes by the section 12 of shrink wrap material, causing the section 12 of shrink wrap material to shrink from a first diameter 18 (FIG. 1) to a second diameter 20. This shrinkage effectively closes section 12 of the liner 14, and shuts off the air/oxygen supply to the substantially enclosed area 15, which results in smothering the fire.

In another embodiment, the shrink wrap material is incorporated into a multilayered container in which each layer is custom tailored to provide desired shrink vs. temperature vs. time performance. The entire waste or storage container also could be fabricated of a thick version of shrink wrap material to produce a passive/active fire protection system.

Figure 3:
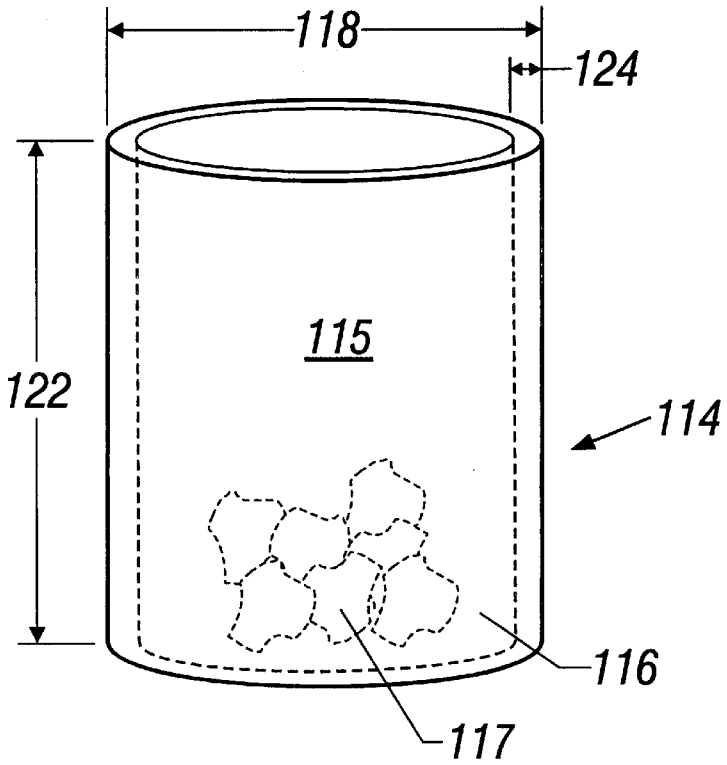
FIG. 3 is a perspective view of a waste container made entirely of shrink wrap material.
Figure 4:
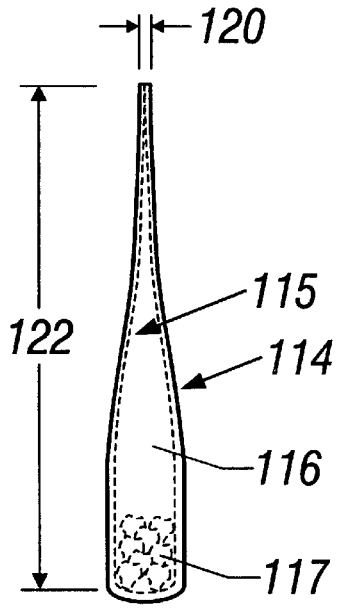
FIG. 4 is a perspective view of the waste container of FIG. 3 after shrinkage.

An example of this second embodiment is depicted in FIGS. 3 and 4. FIG. 3 depicts a typical inflammable waste container 114 entirely made of shrink wrap material having a given thickness 124. The waste container 114 has a given height 22 in FIG. 2 122 and comprises a substantially enclosed area 115 for containing waste 117. The waste container 114 could have any number of configurations as long as the thickness 124 is great enough to provide the container 114 with sufficient rigidity to stand upright when filled with waste 117, and yet thin enough to permit the container to shrink sufficiently, as described in reference to FIG. 4.

Referring to FIG. 4, when a fire occurs in the lower portion 116 of the container 114 and progresses, the heat/flame causes the container 114 to shrink until at least a portion of the container 114 located above the fire source shrinks from a first diameter 118 (FIG. 3) to a second diameter 120. The second diameter 120 is sufficiently small to effectively shut off the air/oxygen supply to the substantially enclosed area 115, resulting in smothering the fire.

In still another embodiment, the shrink wrap material could be configured as a more permanent waste container liner. This more permanent waste container liner could be placed inside of a waste container, and then a regular plastic waste container liner could be placed inside of the permanent liner. If a fire occurred, the fire would quickly burn through the regular liner, thereby exposing the more permanent shrink wrap liner to thermal insult. The shrink wrap liner then would forcibly collapse around the fire source and passively extinguish the fire by depriving it of air/oxygen. The regular plastic waste container liner would be changed regularly. The shrink wrap liner could be changed once a month, or as frequently as necessary depending upon the circumstances of use. This embodiment would add an extra degree of safety without substantially disrupting normal custodial procedures.

Figure 5:
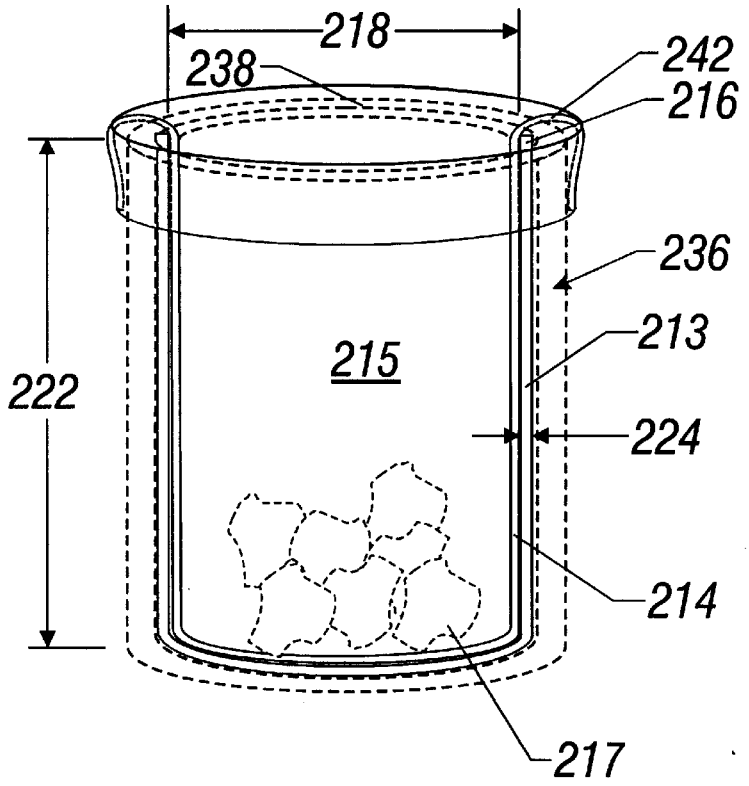
FIG. 5 is a perspective view of a waste container and waste container liner similar to that shown in FIG. 1, except that a semipermanent liner made entirely of shrink wrap material is inserted between the waste container and the waste container liner.
Figure 6:
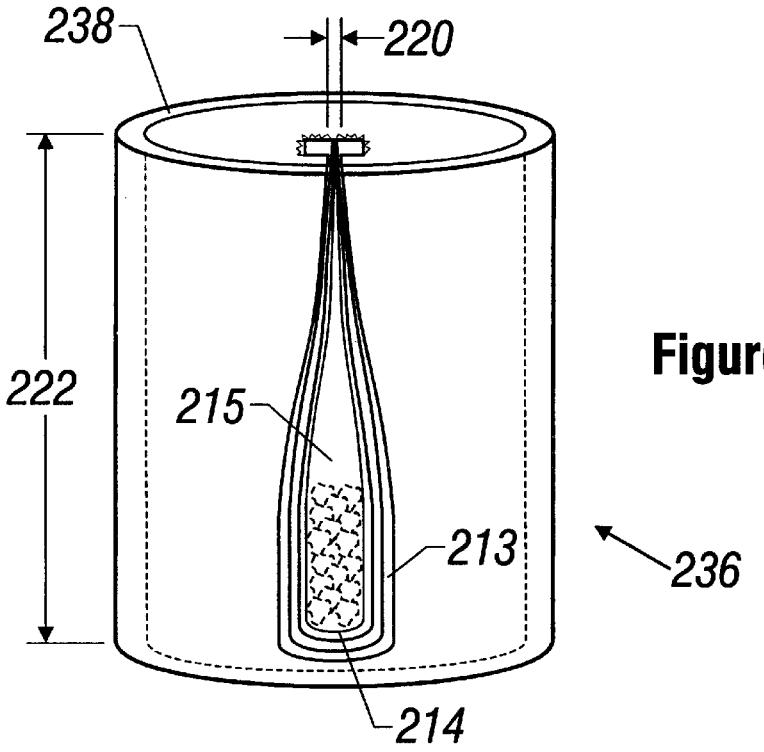
FIG. 6 is a perspective view of the waste container liner of FIG. 5, after shrinkage of the semipermanent liner.

This third embodiment is illustrated in FIGS. 5–6. Referring to FIG. 5, a typical inflammable waste container 236 having a given height 222 is lined with a semipermanent liner 213 made entirely of shrink wrap material. Inside of the semipermanent liner 213 is a typical waste container liner 214 comprising a substantially enclosed area 215 for containing waste 217. The semipermanent waste container liner 213 can have any number of configurations as long as the thickness 224 is small enough to provide sufficient flexibility for the semipermanent liner 213 to collapse into the waste container 236. An upper rim 242 of the liner 214 folds around the upper end 216 of the semipermanent liner 213 and the upper rim 238 of the waste container 236. The upper rim 242 of the waste container liner 214 holds the waste container liner 214 extended from the upper rim 238 of the waste container 236.

As shown in FIG. 6, when a fire occurs and progresses in the waste container 236, the. heat/flame causes at least a portion of the semipermanent liner 213 located above the fire source to shrink from a first diameter 218 (FIG. 5) to a second diameter 220, the second diameter 220 being sufficiently small to effectively shut off the air/oxygen supply to the substantially enclosed area 215, which results in smothering the fire.

The shrink characteristics of the shrink wrap material can be optimized using known procedures. Basically, where the container is a waste/trash container, the typical waste/trash combustion properties should be determined. This would include a determination of the radiant and convective heat flux produced by combustion with respect to various distances from the source of fire. A cylindrical coordinate system would be used to map the various thermal insults. Of particular importance is the temperature vs. vertical distance from the fire source at various radii from the central axis. Based on the foregoing thermal characterization, the transient heat conduction characteristics of a proposed waste/trash can at a specific thickness/diameter and of various axial heights 22 in FIG. 2 would be determined. Also, the thermal emissivity of the inside surface (i.e., the surface facing the fire source) should be modified to increase the radiant thermal absorption to an appropriate level. A five-dimensional array of these parameters should be defined to identify the optimal thickness 24 in FIG. 1 and height 22 in FIG. 2 of the proposed trash/waste can which will shrink to an adequate percentage to close off the oxygen supply to the fire source. Based on the above information, it should be determined whether the polymer material at the specified thickness will ignite/burn as a function of exposure time. If it will not ignite/burn, then the thickness can continue to be increased until its thermal mass capacitance is too great to properly shrink to a point that it restricts the oxygen supply to the fire source. This process will not only optimize the SWF trash/waste can to function properly, but will introduce a factor of added safety to avoid premature burn through. If the material does not fulfill the thermal requirements in its virgin form, chemical additives can be used to enhance or retard the thermal response and to custom tailor the materials to the specific application. In most cases, a fast response at relatively low temperatures (i.e., early event temperatures achieved as the fire source builds to its maximum level) accompanied by a high shrink rate will be desirable.

Shrink wrap material would be useful to manufacture containers that are used to ship and store flammable materials. The parameters of the container can be custom tailored to fit the particular material being shipped and the particular size and shape of the container.

Alternately, shrink wrap material could be used to terminate the flow of fluid through a piping system. The pipe, or section of pipe, could be configured such that, upon internal or external exposure to a predetermined thermal level (i.e., at an upper thermal threshold), the pipe would forcibly shrink/collapse to reduce or stop the flow of the fluid, thereby protecting the piping system from thermal damage and/or limiting the flow of a hot fluid/gas in compliance with a chemical process. Knowing the system into which the invention was to be incorporated, persons of ordinary skill in the art could calculate the appropriate thermal level at which the pipe should shrink or collapse, and could tailor the shrink characteristics of the pipe accordingly using known procedures (described generally above). This concept could be extended to a passive/active thermomechanical fluid switch which activates by itself or on another device which stops fluid flow.

EXAMPLE 1

At least fifteen electronic shrink wrap bags made of polyvinyl chloride having a thickness of 80 gage and a size of one square foot were obtained from National Bag Company, Inc. The bags were used to line a simulated waste can. Waste paper was placed inside of the bags, and a burning piece of waste paper was tossed into the bag. This procedure was repeated fifteen times using fifteen bags. Each time, when the burning piece of waste paper was tossed into the bag, the bag collapsed and smothered the fire.

Persons of ordinary skill in the art will appreciate that many modifications may be made to the embodiments described herein without departing from the spirit of the present invention. Accordingly, the embodiments described herein are illustrative only and are not intended to limit the scope of the present invention.

I claim:

1. A method for reducing a risk of fire or heat damage inside of a container having a height and defining a substantially enclosed area, said method comprising forming at least a section along said height of said container from shrink wrap material, wherein said section comprises a first diameter and said shrink wrap material comprises a thickness; and shrinking said section of said container comprising said shrink wrap material to a second diameter upon exposure to a potential fire source inside of said substantially enclosed area to reduce oxygen supply to said potential fire source.

2. The method of claim 1 wherein said shrink wrap material comprises a thermoplastic material that shrinks in a biaxial mode between about 20–65% when exposed to said potential fire source.

3. A first container having a height and defining a substantially enclosed area, and at least a section along said height comprising shrink wrap material, wherein said section comprises a first diameter and said shrink wrap material comprises a thickness; and wherein, upon exposure to a potential fire source inside of said substantially enclosed area, said shrink wrap material shrinks to a second diameter, reducing oxygen supply to said potential fire source.

4. The first container of claim 3 wherein substantially all of said first container comprises said shrink wrap material.

5. The first container of claim 4 further comprising a second container, wherein said first container comprises a liner for said second container.

6. The first container of claim 5 wherein said shrink wrap material comprises a thermoplastic material that shrinks in a biaxial mode between about 20–65% when exposed to sufficient heat.

7. The first container of claim 6 wherein said shrink wrap material is selected from the group consisting of a polyvinyl chloride, a polyolefin, a copolyolefin, and a copolymer of a polyolefin with ethylene vinyl acetate.

8. The first container of claim 7 wherein said polyolefin and said copolyolefin comprise olefins selected from the group of polyethylene and polypropylene.

9. The first container of claim 4 wherein said shrink wrap material comprises a thermoplastic material that shrinks in a biaxial mode between about 20–65% when exposed to sufficient heat.

10. The first container of claim 9 wherein said shrink wrap material is selected from the group consisting of a polyvinyl chloride, a polyolefin, a copolyolefin, and a copolymer of a polyolefin with ethylene vinyl acetate.

11. The first container of claim 10 wherein said polyolefin and said copolyolefin comprise olefins selected from the group of polyethylene and polypropylene.

12. The first container of claim 3 further comprising a second container, wherein said first container comprises a liner for said second container.

13. The first container of claim 12 wherein said shrink wrap material comprises a thermoplastic material that shrinks in a biaxial mode between about 20–65% when exposed to sufficient heat.

14. The first container of claim 13 wherein said shrink wrap material is selected from the group consisting of a polyvinyl chloride, a polyolefin, a copolyolefin, and a copolymer of a polyolefin with ethylene vinyl acetate.

15. The first container of claim 14 wherein said polyolefin and said copolyolefin comprise olefins selected from the group of polyethylene and polypropylene.

16. The first container of claim 3 wherein said shrink wrap material comprises a thermoplastic material that shrinks in a biaxial mode between about 20–65% when exposed to sufficient heat.

17. The first container of claim 16 wherein said shrink wrap material is selected from the group consisting of a polyvinyl chloride, a polyolefin, a copolyolefin, and a copolymer of a polyolefin with ethylene vinyl acetate.

18. The first container of claim 17 wherein said polyolefin and said copolyolefin comprise olefins selected from the group of polyethylene and polypropylene.

19. A waste container having a height and defining a substantially enclosed area, and at least a section along said height comprising shrink wrap material, wherein said section comprises a first diameter and said shrink wrap material comprises a thickness; and wherein, upon exposure to a potential fire source inside of said substantially enclosed area, said shrink wrap material shrinks to a second diameter, reducing oxygen supply to said potential fire source.

* * * * *